United States Patent [19]

Arnold

[11] 4,183,077

[45] Jan. 8, 1980

[54] LIGHT PROJECTOR

[76] Inventor: August Arnold, Turkenstrasse 89, 8 Munich 40, Fed. Rep. of Germany

[21] Appl. No.: 908,924

[22] Filed: May 24, 1978

Related U.S. Application Data

[63] Continuation-in-part of Ser. No. 668,631, Jun. 8, 1976, abandoned.

[51] Int. Cl.[2] ..... F21S 3/00

[52] U.S. Cl. ..... 362/224; 362/210; 362/225; 362/240; 362/241; 362/243; 362/245; 362/263

[58] Field of Search ..... 362/224, 225, 240, 243, 362/241, 210, 245, 263

[56] References Cited

U.S. PATENT DOCUMENTS 3,087,382 4/1963 De Nygorden ..... 362/243 X 3,379,868 4/1968 Taillon ..... 362/263 X

*Primary Examiner*—Stephen J. Lechert, Jr.

*Attorney, Agent, or Firm*—Fleit & Jacobson

[57] ABSTRACT

A light projector for providing uniform surface area illumination of the type utilized in motion picture studios or the like, employs a housing having a reflector arranged at one end and a Fresnel lens arranged at the other end. At least two linear light sources are located in the interior of the projector at right angles to the optical axis and are electrically connected to a three-phase energization circuit. The lamps are arranged in a star-shaped pattern, relative one to another, and each is a single, self-operating, interchangeable unit, such that by replacing only one of the lamps in the light projector the color temperature of the illumination may be maintained approximately at the desired value.

11 Claims, 12 Drawing Figures

LIGHT PROJECTOR

BACKGROUND OF THE INVENTION

This is a continuation-in-part of U.S. patent application Ser. No. 668,631, filed June 8, 1976, now abandoned.

The present invention relates to a light projector for providing uniform surface area illumination of the type for use either in motion picture studios, stage illumination, or still photography illumination. More specifically, the present invention relates to a light projector of the type having at least two substantially linear light sources, such as those having an electrical arc or filament, located inside a housing.

One of the principal objectives of light projectors, of the subject type, is to obtain a uniform surface area illumination. However, achieving this objective of obtaining uniform surface area illumination involves two problem areas. The first such problem area is how to avoid the dark phase when using a lamp with a substantially linear fluorescent bulb, such as an arc. In this regard, U.S. Pat. No. 2,565,110 teaches to eliminate the undesirable stroboscopic effects caused by alternating current voltages by use of a polyphase circuit containing a even number of phases in excess of four. This patent also teaches the use of three special lamps, which have a supplemental middle electrode. The lamps are arranged in a criss-crossed fashion and are energized by a six-phase polyphase circuit.

Another type of light projector, which is presently known, utilizes a housing, a substantially linear light source, and a collecting lens, with the single lamp being connected to an alternating current voltage source. It is understood, of course, that by linear light source is meant a lamp whose light output (in lumens) is linearly related to the energization voltage. Therefore, each time the voltage goes through zero, the light output of the lamp also goes through zero.

In order to avoid the occurrence of flickering or dark phases, i.e, the times when the sinusoidal energizing wave passes through zero, an electronic auxiliary unit is required which converts the sinusoidal energizing current to a square-wave current, thereby making the zero crossing occur substantially instanteously. However, these electronic auxiliary units increase the cost of the light projector substantially and, also, generally cannot be employed with lamps operating in excess of 575 watts.

It is also known to increase the uniformity of the light output by providing a lamp having a frosted surface. Such lamp is shown in German Utility Model No. 7,344,418.

The other problem concerning uniform area illumination is presented when it is desired to make a color film record of an illuminated scene. The problem presented thereby is that lamps having a substantially linear light output employing an incandescent spot have a life of approximately 500 hours. When such lamps are new, the light output represents a color temperature of approximately 6,200° K. However, over the life of the lamp, the color temperature drops to approximately 5,000° K. after being in service for approximately 300 hours. Although such drop in color temperature is not easily detectable by the human eye, good color film pictures require illumination having an average color temperature of 5,600° K. If the color temperature drops below this level, it is necessary to employ optical filters in the light path of the photographic camera lens, in order to obtain the desired colors in the resultant color pictures. If such optical filters are not utilized, the colors in the resultant photograph fade into a rather greenish tint. However, while these filters can serve to correct the color temperature in the photograph, all such transmission filters entail a lose of light provided to the film. Therefore, use of such filters requires additional light projectors to increase the amount of surface area illumination, in order to achieve the necessary light levels necessary for the photograph. These additional light projectors require additional power and involve additional maintenance, as well as additional service personnel. Accordingly, while optical filters will correct for and provide the required color temperature, such filter correction entails substantially higher cost.

SUMMARY OF THE INVENTION

Accordingly, it is an object of the present invention to provide a light projector which can provide substantially uniform surface area illumination.

It is another object of the present invention to provide a light projector employing a plurality of substantially linear light sources arranged at right angles to the optical axis of a specially constructed housing and being electrically connected to a three-phase AC voltage source.

It is still another object of the present invention to provide a light projector having only two lamps arranged in a cross pattern electrically connected to only two-phases of a three-phase energization system.

It is another object of the present invention to provide a light projector having a specially constructed housing containing a plurality of identical lamps arranged in a star-shaped pattern located intermediate a reflector and a collecting lens and arranged at right angles to the optical axis formed thereby.

These and other objects are accomplished by the present invention by utilizing a specially constructed light projector having at least two lamps, which are connected to a three-phase voltage source and, in this regard, the inventive light projector can be connected to 220-volt sources and also to 220/380-volt sources.

The present invention solves the flickering or dark phase problem by utilizing two, or alternatively three lamps, arranged in a star-shaped pattern and electrically connected to a three-phase power source. Additionally, the present invention solves the problem presented by the color temperature requirement of color film by providing identical bulbs, which are self-operating, interchangeable units, in the housing of the light projector such that, upon the aging of the lamps, only one of the plurality of lamps need be replaced. This is possible since the present invention recognizes that the output spectrum of the plurality of lamps diffuses, and by adding one new lamp to the inventive light projector the spectrum may be "freshened-up" to approximately the optimum 6,000° K.

It should be noted that use of the inventive light projector employing only two lamps connected to a three-phase energization circuit is particularly desirable, since it provides a substantially flicker free illumination at a lower cost relative to the cost of a projector employing three lamps and operating on all three phases of the power source.

DETAILED DESCRIPTION OF THE PREFERRED EMBODIMENT

Figure 1:
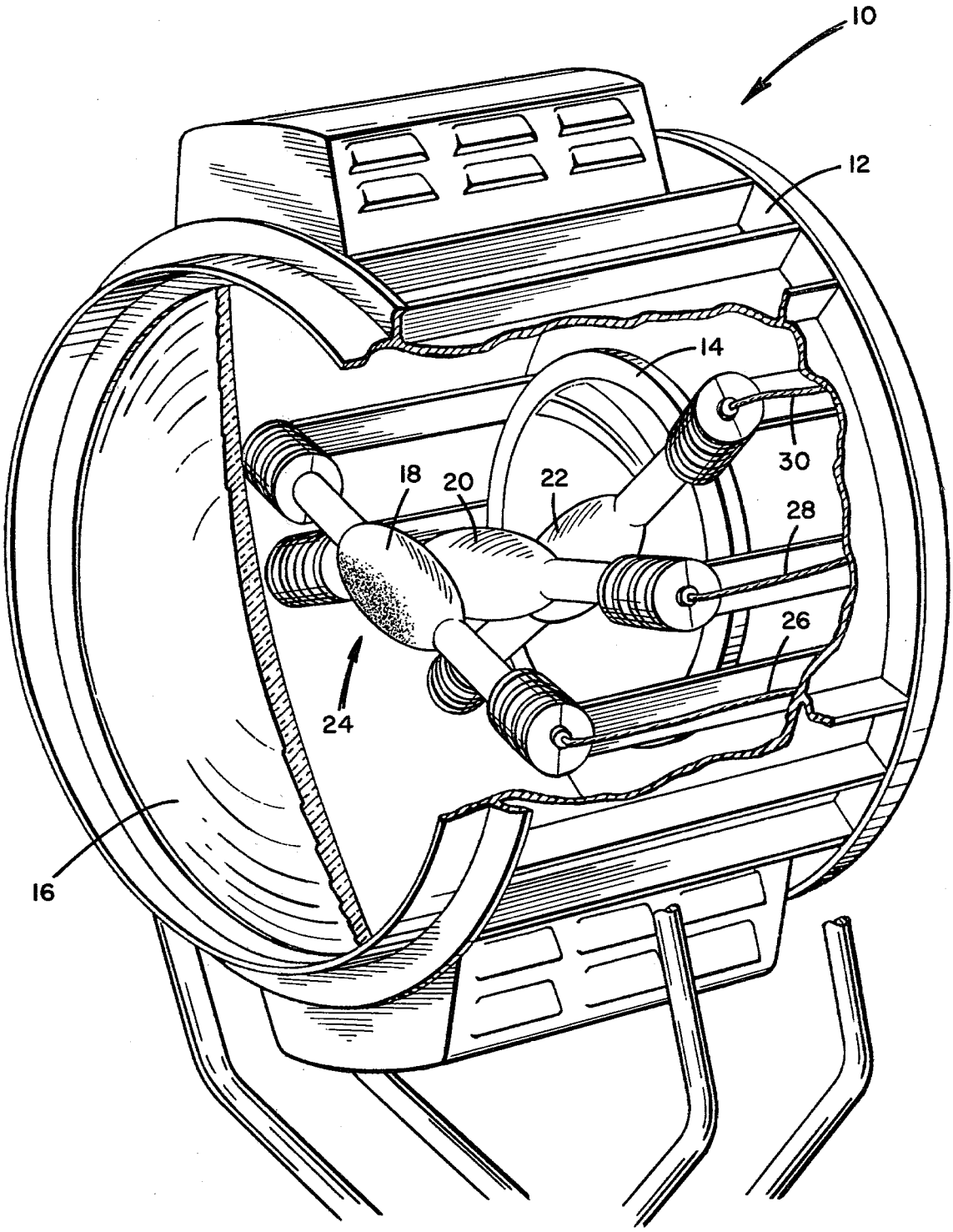
FIG. 1 is a perspective view of an embodiment of the inventive light projector employing three lamps arranged in a star-shaped pattern.

Referring to FIG. 1, the inventive light projector 10 is shown comprising a ventilated, heat-radiating, metal housing 12, a reflector 14, a Fresnel lens 16, and three short-arc halogen-metal vapor lamps, 18, 20 and 22. The reflector 14 is arranged at the rear of the housing 12 and may consist of either a parabolic reflector or a spherical reflector. The bulb or lamp 18, which is located nearest to the Fresnel lens 16, is frosted in the area shown generally at 24. It is the area which transmits the emitted light, in the forward direction, to the Fresnel lens 16. Bulb 18 is not frosted on the side which faces away from the lens 16. In order to provide complete interchangeability, the other two bulbs, 20 and 22, may also have a frosted portion corresponding to portion 24 or bulb 18. As indicated above, it is an object of all light projectors to provide a uniform surface area illumination, and one technique utilized heretofore to provide such uniform illumination has been to use a frosted glass envelope in each of the lamps; however, the use of a lamp having only a portion of the glass envelope frosted provides increased efficiency over a lamp having the entire envelope frosted.

In the embodiment shown in FIG. 1, each of the lamps has a power rating of 575 watts and each of the lamps 18, 20, and 22 is connected to one-phase of a three-phase energization circuit. In FIG. 1, only conductors 26, 28 and 30 can be seen connecting lamps 18, 20, and 22, respectively to the power supply. However, the inventive light projector of FIG. 1 is constructed such that three lamps, having a power rating of 1,200 watts each, may also be employed. The lamps 18, 20, and 22 are arranged perpendicularly to the optical axis formed by the reflector 14 and lens 16, in a star-shaped manner, such that each lamp is separated by an arc of 60°. This arrangement ensures an absolutely uniform illumination of a clearly defined surface area.

Figure 2A:
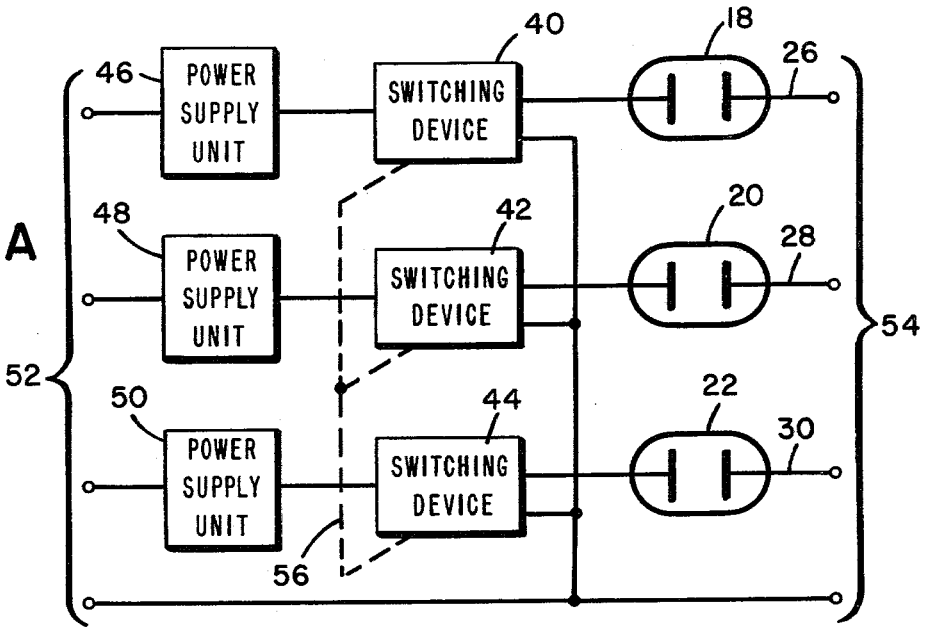
FIG. 2A shows a circuit diagram for connecting the embodiment of FIG. 1 to a three-phase power supply.

Referring now to FIG. 2A, the circuit for connecting the embodiment of FIG. 1 to a three-phase power supply is shown. The individual lamps 18, 20, and 22 are connected respectively by means of switching devices 40, 42, and 44. The actuators of the switching devices 40, 42, and 44 are ganged together so as to be operated simultaneously. Each of the lamps, 18, 20, and 22 is also provided with its own power supply unit for starting the lamp. These power supplies may be of a conventional design and are shown at 46, 48, and 50.

FIG. 2A is shows a four-wire three-phase network, with the input/output lines shown respectively at 52 and 54. Since each of the switching devices 40, 42, and 44 are intended to operate simultaneously, such operation is shown diagrammatically by the dashed-line 56.

Figure 2B:
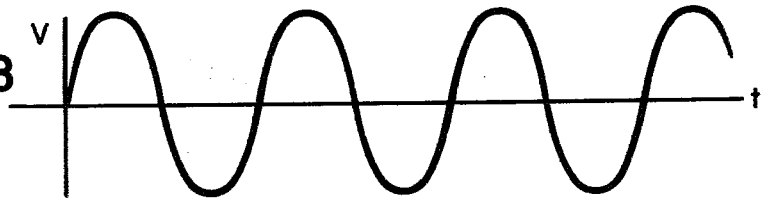
FIGS. 2B, 2C, and 2D show the waveform of the voltage impressed across each of the three lamps of FIG. 1.
Figure 2C:
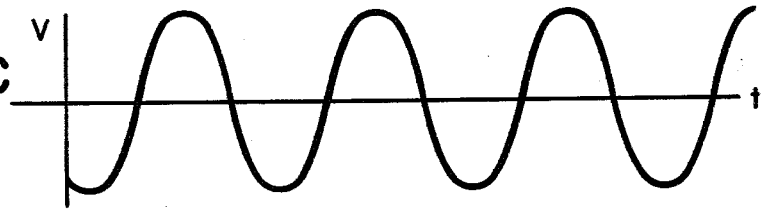
Figure 2D:
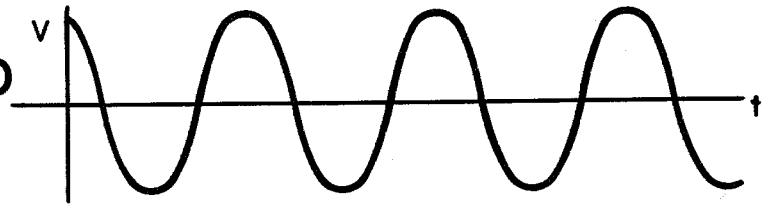
Figure 2E:
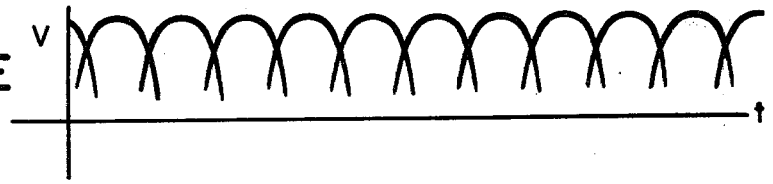
FIG. 2E shows the sum of the voltage waveforms of FIGS. 2B, 2C, and 2D.

FIGS. 2B, 2C, and 2D show the waveforms of the voltages impressed across lamps 18, 20, and 22, respectively. As may be seen, the three-phases are in the conventional phase relationship, i.e., separated by a 120° difference. Accordingly, there is no time when all of the lamps have a zero voltage impressed across them. FIG. 2E is the graphical representation of the sum of waveforms of 2B, 2C, and 2D and, as may be seen, only a small amount of fluctuation or ripple is contained in this summed waveform. The waveform of FIG. 2E is proportional to the light emitted by the entire light projector, i.e., by lamps 18, 20, and 22 and, accordingly, FIG. 2E shows that only a very small fluctuation in the light output intensity occurs.

Figure 3:
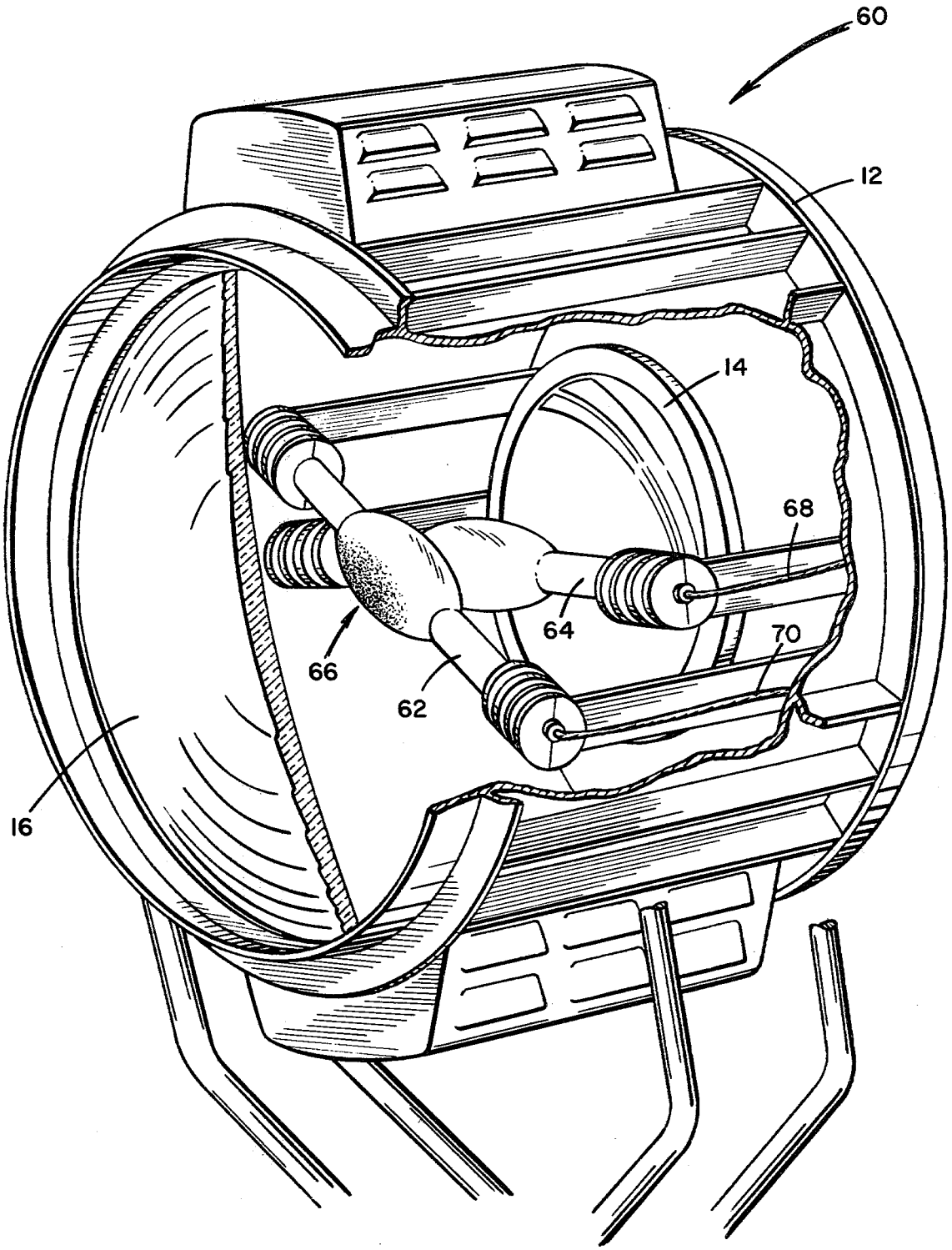
FIG. 3 shows another embodiment of the inventive light projector utilizing two lamps arranged in a crossed pattern.

FIG. 3 is another embodiment 60 of the inventive light projector, employing only two individual lamps, 62 and 64. Once again, lamp 62 is provided with a frosted portion only at the surface which is adjacent the Fresnel lens 16, such frosted portion is shown typically at 66. Because the lamps are identical and interchangeable, lamp 64 may also have a frosted portion. As in the embodiment of FIG. 1, the lamps 62 and 64 are connected to a three-phase energization circuit; however, in this embodiment the lamps are connected to only two-phases of the three-phase circuit. The electrical connections are achieved by appropriate electrical conductors, such as conductor 68, which connects one side of lamp 64 and conductor 70, which connects one side of lamp 62 to the three-phase energization circuit.

Figure 4A:
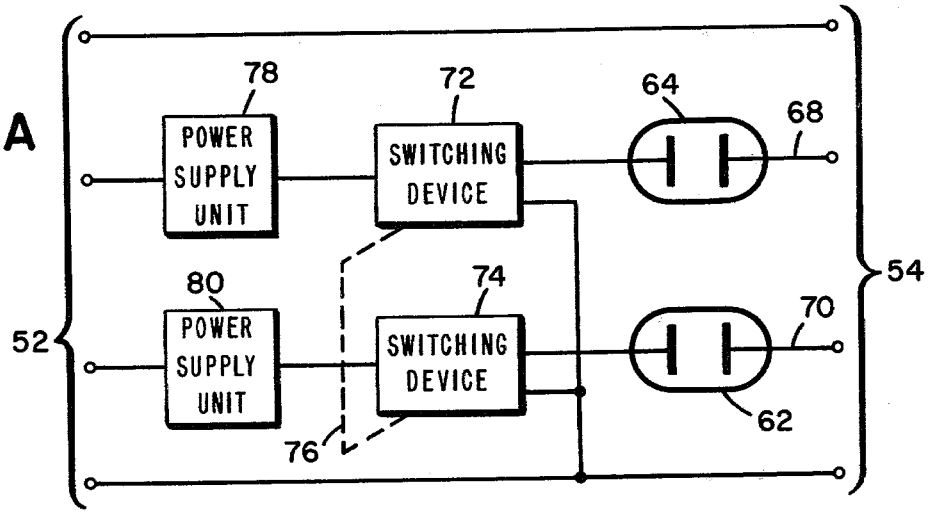
FIG. 4A is a circuit diagram for the connection of the embodiment of FIG. 3 to a three-phase power supply.

In FIG. 4A, the embodiment of FIG. 3 is shown connected to a 220-volt three-phase network and, as in the embodiment of FIG. 1, each lamp 64 and 62 is provided with a switching device 72 and 74, respectively, such switching devices are ganged together, as shown by the dashed-line 76, so as to be actuated simultaneously. Each lamp 68, 70 is also provided with its own power supply 78, 80, respectively for starting the lamp. Once again, the three-phase 220-volt power is shown having four input lines at 85 and four output lines at 85. The electrical conductors 68 and 70, which were connected to the appropriate lamps in FIG. 3 are also seen in FIG. 4A.

Figure 4B:
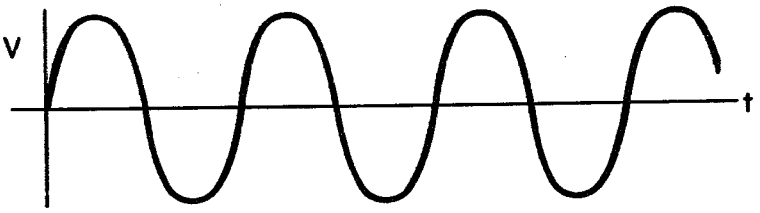
FIGS. 4B and 4C show the waveform of the voltage impressed across the lamps of the embodiment of FIG. 3.
Figure 4C:
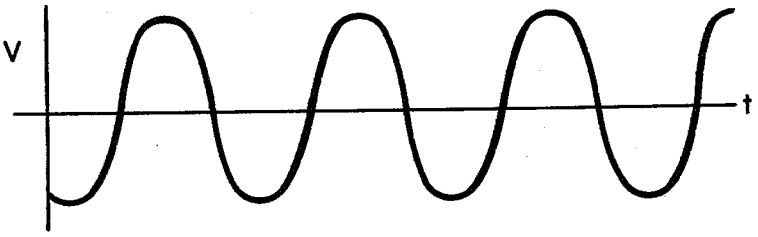
Figure 4D:
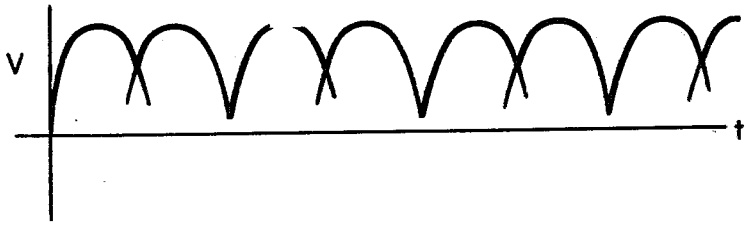
FIG. 4D shows the sum of the waveforms of FIGS. 4B and 4C.

FIGS. 4B and 4C show the waveforms of the voltages impressed across lamps 62 and 64, respectively and, as may be seen, such voltages are once again 120° out of phase. FIG. 4D shows the summation of the two voltages of FIGS. 4B and 4C across the lamps. This waveform is an approximate representation of the light output from the light projector as produced by these two lamps. In this regard, as may be seen, although there is more fluctuation or ripple than that produced by the three-phase connection, such fluctuation is still relatively small compared to a full sinusoidal wave, which would be the case when energizing two individual lamps from two separate AC circuits.

Figure 5:
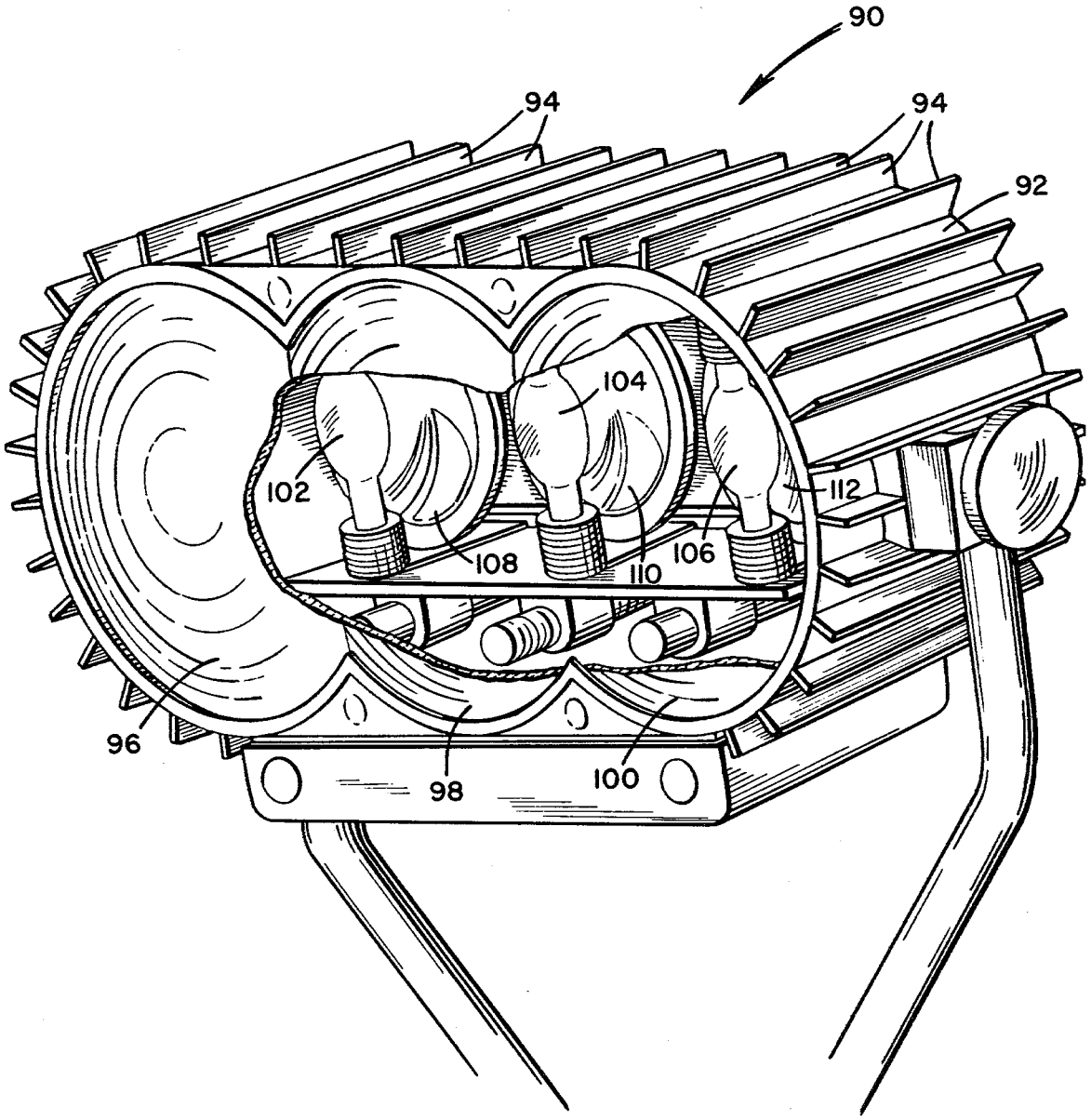
FIG. 5 is a perspective view of another embodiment of the inventive light projector employing three linear light sources arranged in a row.

FIG. 5 shows another embodiment 90 of the inventive light projector having a housing 92 formed with a plurality of heat-radiating fins, shown typically at 94. The housing 92 is provided at the light output end with three individual Fresnel lenses 96, 98, and 100. Located inside the housing 92 are three lamps 102, 104, and 106, each of which produces a substantially linear light output and is of the type utilized in the embodiments discussed above. Located at the rear of the housing 92 are three reflectors, 108, 110 and 112, which are arranged to cooperate with lamps 102, 104 and 106, respectively. Each of the three lamps 102, 104 and 106 are connected to one of the power lines in a three-phase energization circuit, exactly as shown in FIGS. 2A through 2D.

By means of the lamp arrangement shown in FIG. 5, the advantages provided by the present invention are all maintained, i.e., uniform surface area illumination which is free from any dark-phase phenomena and the ability to replace only one aged lamp, to freshen-up the color temperature. Additionally, since the lamps are not arranged in a star-shaped pattern and are not in proximity with each other, the lamps operate at a lowr temperature, which serves to extend bulb life.

It is, of course, understood that the above discussion of the present invention is given by way of example only and is not intended to limit the scope of the present invention, except as set forth in the appended claims.

I claim:

1. A high-intensity light projector of the type for use in a motion picture studio or the like, comprising: a housing having a rear portion closed by a reflector and a front portion closed by a Fresnel lens, at least two linear light sources disposed intermediate said reflector and said lens and at right angles to the optical axis as defined by said lens and said reflector, wherein said light sources are arranged one in front of another and wherein the longitudinal axis of each light source is at an angle with the longitudinal axis of the adjacent light source, and each of said light sources being electrically connected to one phase of a three-phase electrical power network.

2. The light projector of claim 1, wherein the linear light source which is arranged nearest to the said Fresnel lens is frosted at its central portion, thereby ensuring a uniform surface illumination.

3. The light projector of claim 2, wherein each of said light sources is frosted in its central portion on the side which is towards said Fresnel lens.

4. The light projector of claim 1, wherein said light sources are arc discharge lamps.

5. The light projector of claim 1, wherein said light sources are halogen incandescent devices.

6. A light projector of the type for use in a motion picture studio or the like having a housing bounded on the rear by a reflector and in the front by a Fresnel lens and having at least two linear light sources located between said reflector and said lens and disposed at right angles to the optical lens, characterized in that the linear light sources comprise three lamps arranged one in front of another with an arc of 60° between the longitudinal axis of each adjacent lamp, each lamp being arranged having its longitudinal axis intersecting the optical axis and each lamp being connected to one phase of a three-phase power network.

7. The light projector of claim 6, wherein the linear light source which is arranged nearest to the said Fresnel lens is frosted at its central portion, thereby ensuring a uniform surface illumination.

8. The light projector of claim 7, wherein each of said light sources is frosted in its central portion on the side which is towards said Fresnel lens.

9. The light projector of claim 6, wherein said light sources are arc discharge lamps.

10. The light projector of claim 6, wherein said light sources are halogen incandescent devices.

11. A light projector of the type for use in a motion picture studio or the like, comprising a housing, three linear light sources arranged in said housing, three reflectors located intermediate the rear of said housing and said light sources and each being located to reflect the light of a respective light source, three Fresnel lenses each located in front of each of said linear light sources, said light sources being arranged at right angles to the optical axes of said reflectors and lenses, whereby the light produced by said linear light sources is reflected by said reflectors through said Fresnel lenses, and a three-phase power source electrically connected to said light sources such that each linear light source is energized by a single phase of said three-phase power source.

* * * * *